United States Patent [19]

Wagstaff

[11] Patent Number: 4,897,070

[45] Date of Patent: Jan. 30, 1990

[54] TWO-WHEELED MOTORIZED TOY

[76] Inventor: Ronald D. Wagstaff, 17 Myrtle Ave., Caldwell, N.J. 07006

[21] Appl. No.: 338,589

[22] Filed: Apr. 14, 1989

[51] Int. Cl.[4] ..... A63H 15/04; A63H 13/18; A63H 30/04; A63G 25/00

[52] U.S. Cl. ..... 446/273; 446/325; 446/456; 280/298; 180/6.5

[58] Field of Search ..... 446/268, 269, 273, 274, 446/279, 322, 324, 325, 326, 396, 437, 438, 439, 454, 455, 456, 458, 289, 462; 280/205, 206, 207, 208; 180/6.2, 6.48, 6.5

[56] References Cited

U.S. PATENT DOCUMENTS

| | | | |
|---|---|---|---|
| 90,546 | 5/1869 | Huntington | 280/208 |
| 1,153,250 | 9/1915 | Phillips | 446/273 |
| 1,795,271 | 3/1931 | Buttigieg | 446/279 |
| 2,006,881 | 7/1935 | Boissoneau | 446/274 |
| 2,892,300 | 8/1957 | Rogers | 446/273 X |
| 2,909,145 | 10/1959 | Hertelendy | 280/208 X |
| 2,977,714 | 4/1961 | Gibson | 446/458 |
| 3,313,365 | 4/1967 | Jackson | 180/6.2 |
| 3,402,505 | 9/1968 | Nakamura | 446/454 |
| 3,555,725 | 1/1971 | Orfei et al. | 446/462 |
| 3,893,707 | 7/1975 | Samsel | 280/208 |
| 4,310,987 | 1/1982 | Chieffo | 446/458 |

*Primary Examiner*—Robert A. Hafer
*Assistant Examiner*—D. Neal Muir
*Attorney, Agent, or Firm*—Weingram & Zall

[57] ABSTRACT

A two-wheeled toy includes a central housing supported on a rotatable shaft between the wheels. The diameter of the wheels is larger than the housing, with a figure mounted on the housing extending above the wheels. The housing includes a miniature electric motor, gearing, batteries and a switch to activate the motor and drive the wheels. The batteries are mounted in the bottom of the housing to provide a weight and low center of gravity to maintain the housing and figure in an upright position during movement. The figure limits counter-rotation of the housing about the shaft when the wheels start to turn and move forward. The shaft extends outwardly from the wheels and provides a stop which prevents the wheels from falling sideways. The wheels may also be driven independently by separate motors and shafts and may be remotely controlled to permit turning and movement in different directions while the housing remains upright.

10 Claims, 2 Drawing Sheets

TWO-WHEELED MOTORIZED TOY

BACKGROUND OF THE INVENTION

1. Field of the Invention

The present invention relates to a two-wheeled motor-driven toy and particularly to a toy having two wheels and an axial shaft supporting a central housing which is maintained in a vertical position.

2. Description of the Prior Art

Previous two-wheeled toys have utilized a miniature electric motor, gearing and a battery to drive the wheels which were mounted on a central shaft, such as shown in U.S. Pat. No. 2,977,714. The motor was suspended from the shaft within a housing cavity formed by the inner open ends of the wheels. A clutch controlled the connection to the shaft and the degree of motion of each wheel.

It also has been known to maintain a wheeled toy in an upright position by using a weight at a lower portion within the supporting frame, as shown in U.S. Pat. No. 2,006,881.

These devices, however, did not provide a separate housing mounted between two wheels which was maintained in an upright position while the wheels rotated and moved the toy along a path. There was also no way to prevent the wheels from falling to one side.

SUMMARY OF THE INVENTION

It is, therefore, the primary object of the invention to provide a unique two-wheeled toy mechanism which supports a central housing and a figure that is maintained in an upright position as the wheels rotate and move along a path.

A further object is to provide a means for preventing a two-wheeled toy from falling over on a side as it moves along.

It is also another object of the invention to utilize a miniature electric motor, battery and switch to activate and drive the wheels, with the battery also serving as a weight to assist in achieving the vertical housing orientation.

An additional object is to provide a two-wheeled toy having independent drives for each wheel which may be remotely controlled to permit turning and movement in various directions while maintaining the housing in an upright position.

These objects are achieved with a novel arrangement of a central housing freely supported on an axle or shaft between two like wheels having diameters that are larger than the housing. A toy electric motor, gears and batteries are mounted within the housing to drive the shaft and wheels, and a switch on the outside of the housing activates the batteries and motor. The batteries are mounted on the bottom of the housing to provide a weight and low center of gravity which serve to maintain the housing upright while the wheels rotate and move along a path. A figure mounted on the top of the housing extends beyond the diameter of the wheels and provides a stop to limit counter-rotation of the housing when starting the wheels in motion to aid in holding the housing upright while moving forward. The ends of the shaft also extend outwardly from the sides of each wheel to provide further limits to tipping of the wheels in a sideways direction and assist in causing the wheels and housing to return to the vertical position. The wheels may also be driven independently by two separate motors and remotely controlled to permit varied movement. Other objects and advantages will become apparent from the following description in conjunction with the accompanying drawings.

DESCRIPTION OF THE PREFERRED EMBODIMENTS

Figure 1:
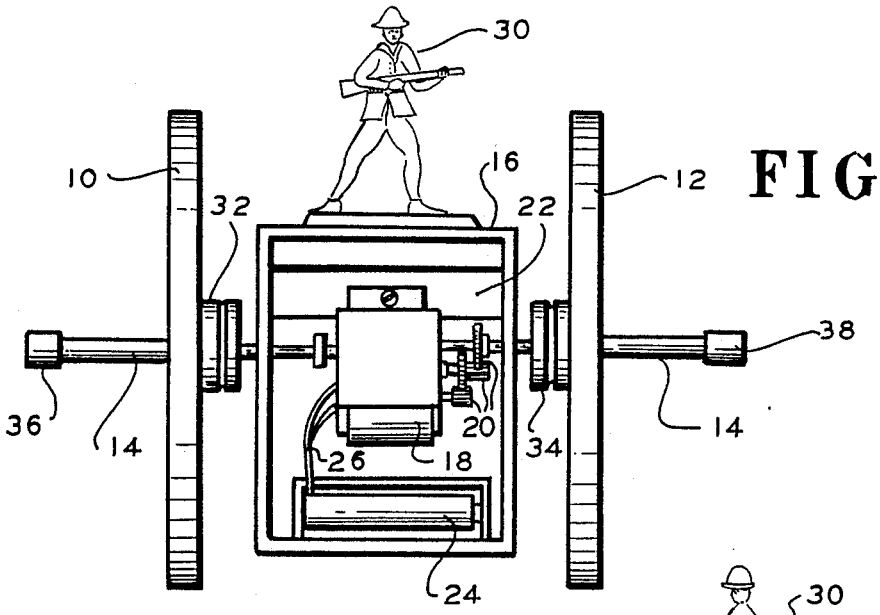
FIG. 1 is a front view of the two-wheeled toy with the front panel of the central housing removed to show the electric motor, shaft, gearing and battery.
Figure 2:
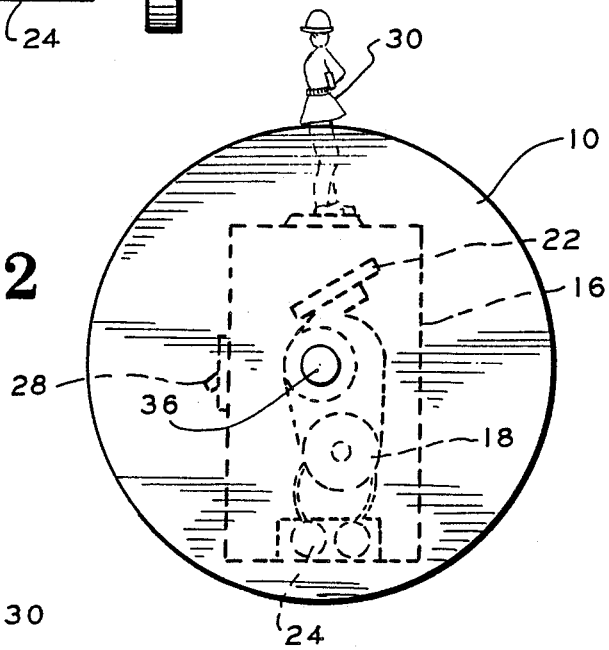
FIG. 2 is a side view showing one wheel, the central shaft, and a miniature toy figure extending above the wheel from the housing.
Figure 3:
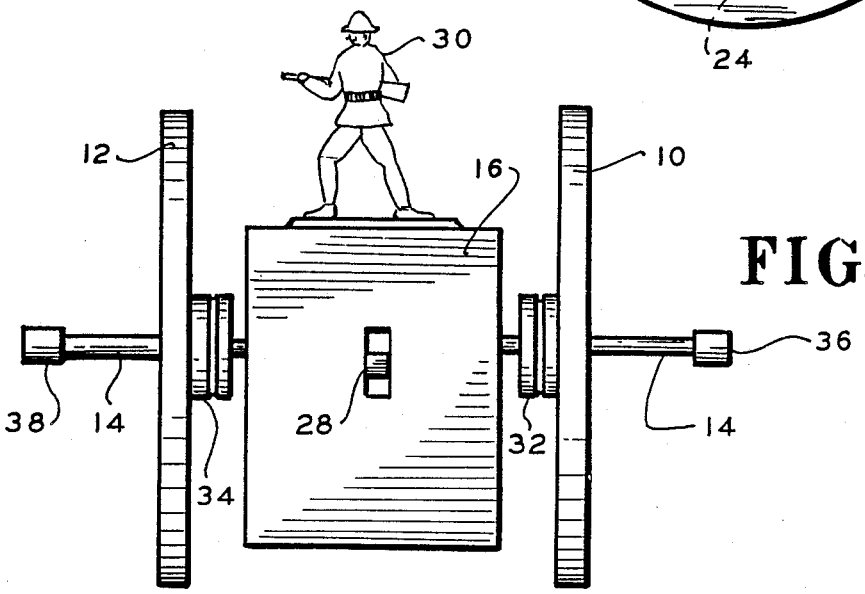
FIG. 3 is a back view showing the wheels, central housing, figure mounted on the housing and a switch on the back panel.

As shown in FIG. 1, a pair of wheels 10,12, which may, for example, be several inches in diameter, are spaced apart along a central shaft or axle 14. The wheels are secured to and rotate with the shaft. Supported freely on the shaft between the two wheels is a central housing 16 which is smaller in height than the diameter of the wheels. The front cover of the housing, which may be a sliding panel, is removed to show the internal elements. These include a standard miniature toy electric motor 18 with gearing 20 including a drive gear connected to the motor, an intermediate idler gear, and a gear secured to central shaft 14. The motor bracket is secured to a cross-member 22 between the side walls of housing 16 and supports the motor below the shaft. A pair of batteries 24 are mounted on the bottom wall of the housing and are connected by wires 26 to supply power to the electric motor. An electric switch 28 on the back wall of the housing, as shown in FIG. 3, turns the motor on and off. The batteries are preferably two small standard 1.5 volt units connected in series with each other and with the switch and motor.

A figure, such as a toy soldier 30, is mounted on the top wall of the housing and extends above the height of the wheels. A pair of spacers 32,34 are secured to the inside of the respective wheels 10,12 for added strength and are slightly spaced from the side walls of the housing to avoid friction and rubbing on the housing. The housing extends below the central shaft a greater distance than above the shaft to provide a low center of gravity in conjunction with the weight of the batteries at the bottom. The central shaft 14 also extends outwardly from the sides of each wheel and includes protective end caps 36,38 at opposite ends.

In operation, the switch 28 is turned on to connect the batteries to the motor which starts to turn the central shaft and wheels to move the toy forward. At this point the housing rotates oppositely due to counter torque by the motor until the wheels begin to turn. The toy soldier however, which extends above the wheels, limits the counter rotation by hitting the surface behind the toy and insures forward motion. The weight of the batteries and low center of gravity then cause the housing and figure to right itself and stabilize in a vertical position as the forward movement continues. Tipping of the wheels and housing to either side is also limited by the extended ends of the shaft and caps which hit the surface at the side. The low center of gravity and weight of the batteries again cause the housing to return to a vertical position during continued forward movement. Thus, from any position, the device will return to an upright orientation. The entire device is also relatively light and can move quite rapidly.

Figure 4:
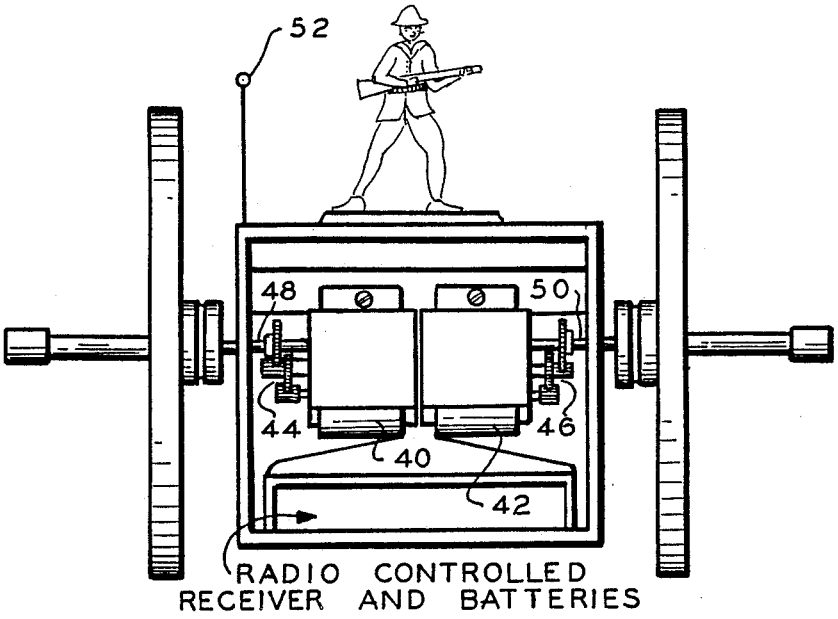
FIG. 4 is a front view with the front panel removed to show the toy with separately driven shafts, motors and wheels, and an antenna and receiver to permit remote control.

As shown in FIG. 4, each wheel can be driven independently by separate motors 40,42 and gearing 44,46 connected to two axial shafts 48,50. A remote control system, including a radio transmitter, can supply a control signal to an antenna 52 connected to an internal radio receiver coupling the signal to each motor. The motors can cause the wheels to move together in a forward or reverse direction, or move in opposite directions to cause turning in a circle, or in various curved paths while maintaining the housing in an upright position. Standard radio-controlled devices may be employed.

Other variations can include removable and interchangeable wheels, and removable end caps which can be of different shapes. Several like toys can be ganged together through connecting ends of the shafts. The configuration of the housing can have other shapes, such as oval instead of rectangular, and a variety of figures can be used in place of the soldier. The motor, gearing, batteries, wheels and housing can also be of different sizes for larger or smaller toys. While only a limited number of embodiments have been illustrated and described, many other variations may be made in the particular design and configuration without departing from the scope of the invention as set forth in the appended claims.

What is claimed is:

1. A self-propelled toy comprising:

a pair of like wheels spaced apart along a common axis and having a given diameter;

axial shaft means connected to said wheels for rotation therewith and having ends extending outwardly therefrom along said axis;

a central housing freely supported on said shaft means between said wheels and extending a larger distance below said shaft means than above said shaft means, the height of said housing being smaller than the diameter of said wheels;

miniature electric motor means supported in said housing below said shaft means and including drive gear means;

means for coupling said drive gear means to said shaft means for driving said shaft means and wheels;

electrical energy supply means mounted at the bottom of said housing and coupled to said motor means; and electrical control means mounted on said housing and connected to said energy supply means and to said motor means to actuate said motor means;

said energy supply means having a weight and position providing a low center of gravity for maintaining said housing in an upright position.

2. The device of claim 1 including a figure mounted on the top of said housing and extending beyond the diameter of said wheels, said figure providing a limit to counter-rotation of said housing upon initial movement of said wheels to aid in maintaining said upright position of said housing.

3. The device of claim 2 wherein said outwardly extending ends of said shaft means provide limits to tipping of said wheels to either side thereof and assist in maintaining said toy in an upright position.

4. The device of claim 3 wherein said means for coupling said drive gear include gear means secured to said shaft means and intermediate gear means coupled therebetween.

5. The device of claim 4 wherein said electrical energy supply means includes a battery.

6. The device of claim 5 wherein said electrical control means is a switch connecting said battery to said motor means.

7. The device of claim 3 including a pair of spacers positioned between respective wheels and said housing.

8. The device of claim 3 including pair of removable end caps on respective extending ends of said shaft means.

9. The device of claim 4 wherein said axial shaft means includes two axial shafts connected respectively to said wheels, said motor means including a pair of like motors each having drive gear means, said coupling means coupling respective drive gear means and motors to respective axial shafts for independently driving said shafts and respective wheels, and said electrical control means includes means for applying remote signals for independently controlling said motors and wheels.

10. The device of claim 9 wherein said means applying remote signals includes an antenna mounted on said housing and a radio-controlled receiver therein.

* * * * *